US010165627B2

(12) United States Patent
Choi

(10) Patent No.: US 10,165,627 B2
(45) Date of Patent: Dec. 25, 2018

(54) HEATING ELEMENT HAVING COMMUNICATION WINDOW

(71) Applicant: LG CHEM, LTD., Seoul (KR)

(72) Inventor: Hyeon Choi, Daejeon (KR)

(73) Assignee: LG CHEM, LTD., Seoul (KR)

( * ) Notice: Subject to any disclaimer, the term of this patent is extended or adjusted under 35 U.S.C. 154(b) by 646 days.

(21) Appl. No.: 14/767,750

(22) PCT Filed: Oct. 15, 2014

(86) PCT No.: PCT/KR2014/009671

§ 371 (c)(1),
(2) Date: Aug. 13, 2015

(87) PCT Pub. No.: WO2015/056971

PCT Pub. Date: Apr. 23, 2015

(65) Prior Publication Data

US 2015/0382406 A1 Dec. 31, 2015

(30) Foreign Application Priority Data

Oct. 15, 2013 (KR) ..... 10-2013-0122782

(51) Int. Cl.

| | |
|---|---|
| ***H05B 3/28*** | (2006.01) |
| ***H05B 3/86*** | (2006.01) |
| ***H05B 3/84*** | (2006.01) |
| *H01C 17/00* | (2006.01) |

(52) U.S. Cl.

CPC ..... *H05B 3/84* (2013.01); *H01C 17/00* (2013.01); *H05B 2203/005* (2013.01); *H05B 2203/008* (2013.01); *H05B 2203/011* (2013.01); *H05B 2203/013* (2013.01)

(58) Field of Classification Search

None

See application file for complete search history.

(56) References Cited

U.S. PATENT DOCUMENTS

| | | | | |
|---|---|---|---|---|
| 6,559,419 | B1 * | 5/2003 | Sol | B32B 17/10192 219/203 |
| 6,734,396 | B2 | 5/2004 | Sol et al. | |
| 8,022,333 | B2 | 9/2011 | Maeuser | |
| 8,431,867 | B2 | 4/2013 | Blanchard et al. | |
| 2003/0116551 | A1 | 6/2003 | Sol et al. | |
| 2004/0065651 | A1 | 4/2004 | Voeltzel | |

(Continued)

FOREIGN PATENT DOCUMENTS

| | | | |
|---|---|---|---|
| CN | 101998938 | A | 3/2011 |
| EP | 1908584 | A1 | 4/2008 |

(Continued)

*Primary Examiner* — Joseph M Pelham
(74) *Attorney, Agent, or Firm* — Dentons US LLP

(57) ABSTRACT

Disclosed is a heating element, including: a substrate; a first bus bar provided on the substrate; a second bus bar which is provided on the substrate so as to be opposite to the first bus bar; and a heating pattern which is provided to electrically connect the first bus bar and the second bus bar, wherein the heating pattern includes a first pattern region which is in contact with the first bus bar and a second pattern region which is in contact with each of the second bus bar and the first pattern region and the first pattern region has an opening region which serves as a communication window.

13 Claims, 2 Drawing Sheets

(56) References Cited

U.S. PATENT DOCUMENTS

| | | | | |
|---|---|---|---|---|
| 2009/0044464 | A1* | 2/2009 | Schmidt | B32B 17/10036 52/171.2 |
| 2009/0166347 | A1* | 7/2009 | Blanchard | B32B 17/10036 219/201 |
| 2011/0215078 | A1 | 9/2011 | Williams | |
| 2013/0175255 | A1 | 7/2013 | Kim et al. | |
| 2013/0213949 | A1* | 8/2013 | Lisinski | H05B 3/84 219/203 |
| 2014/0117003 | A1* | 5/2014 | Choi | H05B 3/84 219/203 |
| 2015/0232067 | A1* | 8/2015 | Schall | B60S 1/026 219/203 |

FOREIGN PATENT DOCUMENTS

| | | | |
|---|---|---|---|
| KR | 1020130107256 | A | 10/2013 |
| WO | 2005011052 | A2 | 2/2005 |
| WO | 2007083038 | A2 | 7/2007 |
| WO | 20121036459 | A2 | 3/2012 |
| WO | 20131141629 | A1 | 9/2013 |

* cited by examiner

[Figure 1]
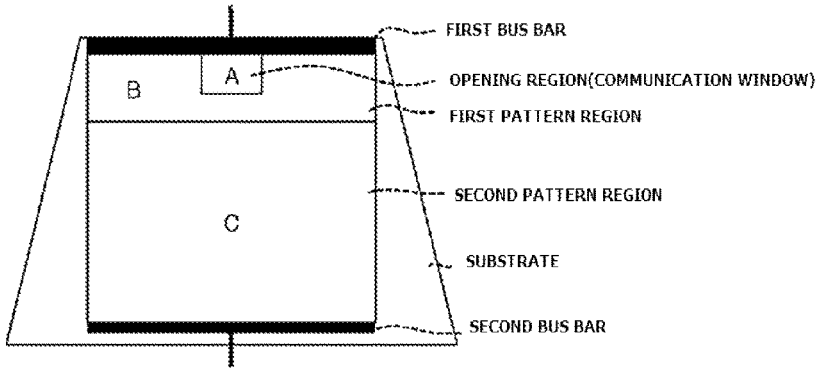
[Figure 2]
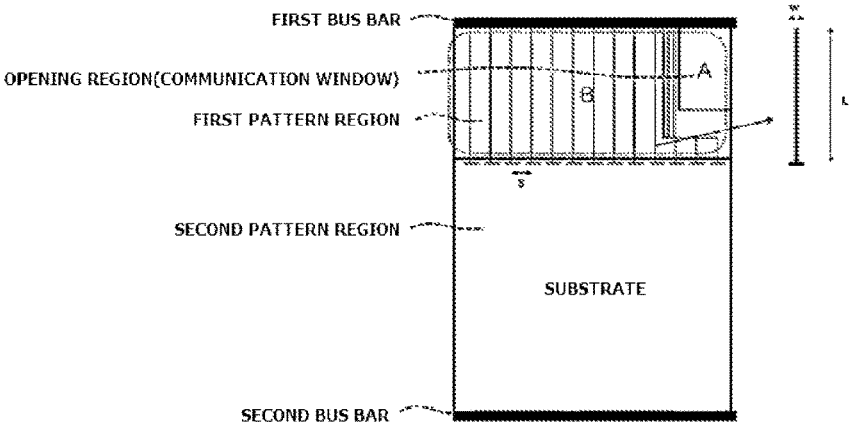

[Figure 3]
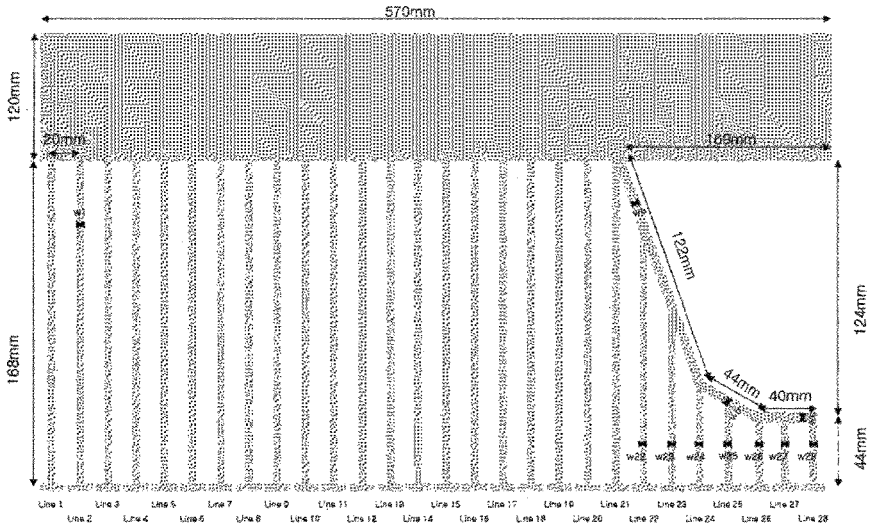
[Figure 4]
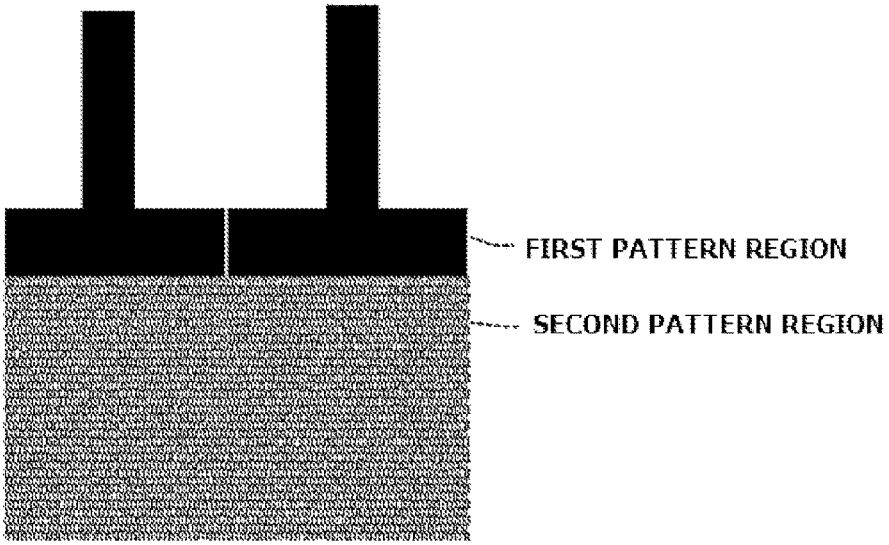

HEATING ELEMENT HAVING COMMUNICATION WINDOW

TECHNICAL FIELD

This application is a National Stage Entry of International Application No. PCT/KR2014/009671, filed Oct. 15, 2014, and claims the benefit of the priority to Korean Application No. 10-2013-0122782, filed Oct. 15, 2013, both of which are incorporated by reference in their entirety for all purposes as if fully set forth herein.

In the present specification, a heating element is disclosed and more particularly, a heating element having a communication window which is capable of communicating with the outside is disclosed.

BACKGROUND ART

In winter or on a rainy day, frost is formed on a glass surface of a vehicle because of a temperature difference outside and inside of the vehicle. In addition, in the case of an indoor ski resort, a dew condensation phenomenon occurs because of a temperature difference inside where there is a slope and outside of the slope. In order to solve this, a heating glass has been developed. The heating glass uses a concept where after attaching a hot line sheet onto the glass surface or directly forming a hot line on the glass surface, electricity is applied to both terminals of the hot line to generate heat from the hot line, thereby increasing the temperature of the glass surface.

In order to manufacture the heating glass, a transparent conductive layer is required. A type of transparent conductive layer includes a layer formed by using a transparent conductive material such as indium tin oxide (ITO) or a film formed by forming a metal thin film using a metal material such as Ag which is an opaque conductive material and forming a transparent insulating material around the metal thin film. Further, a transparent conductive layer may be formed such that a metal material which is an opaque material is patterned to increase an opening ratio, thereby increasing transmittance and a line width of a metal pattern is limited to 30 micrometer or less to limit recognition of the pattern.

When the transparent conductive layer formed by the above-mentioned methods is used, the transparent conductive layer may serve as a heating element and also blocks an electromagnetic wave due to high conductivity. Currently, various electronic apparatuses using an electromagnetic wave through a front glass of a vehicle are used. For example, a device for automatically collecting a toll on the highway or a GPS for a navigation system performs communication using an electromagnetic wave. Further, electromagnetic communication is performed through the glass of the vehicle in order to use a mobile phone. The above-mentioned transparent conductive layer has a problem that lowers a communication reception rate for communication using the above-mentioned electromagnetic wave.

In order to solve the above-mentioned problem, methods are suggested to remove a transparent conductive layer at a part of the glass of the vehicle, specifically, portion where a rear view mirror is attached to be used as a communication window. When a heating performance is applied to the front glass of the vehicle, bus bars which connect the heating element with a power supplying unit are mainly provided at a top portion and a bottom portion of the glass of the vehicle. In this case, when the transparent conductive layer is removed from the communication window zone, a distance between the bus bars provided at the top portion and the bottom portion of a region where the communication window is provided is inevitably shorter than a distance between bus bars of the other zones and thus electric current which flows in the heating element is concentrated, so that heat is nonuniformly generated.

In order to solve the problems, a method which forms transparent heating elements which have different conductivity in each area and a method which uses two or more bus bars (U.S. Pat. No. 6,734,396) are suggested. However, the above methods may cause the increase of manufacturing cost, so that the above methods are not easy to be commercially adopted.

DETAILED DESCRIPTION OF THE INVENTION

Technical Problem

In the present specification, disclosed is a heating element which controls nonuniform heating caused by a distance difference between bus bars even when a communication window with the outside is formed in the heating element.

Technical Solution

A first exemplary embodiment of the present specification provides a heating element including a substrate, a first bus bar provided on the substrate, a second bus bar which is provided on the substrate so as to be opposite to the first bus bar, and a heating pattern which is provided to electrically connect the first bus bar and the second bus bar, wherein the heating pattern includes a first pattern region which is in contact with the first bus bar and a second pattern region which is in contact with each of the second bus bar and the first pattern region, and the first pattern region has an opening region which serves as a communication window and a ratio of a sheet resistance of the second pattern region with respect to a sheet resistance of the first pattern region is 1 or more.

In one exemplary embodiment of the present specification, the first pattern region may include heating lines which connect the first bus bar and the second pattern region.

In one exemplary embodiment of the present specification, the first pattern region may include heating lines connecting the first bus bar and the second pattern region and the heating lines may not be connected to each other in a portion other than a heating line which partitions the opening region and independently connect the first bus bar and the second pattern region. Here, the heating line partitioning the opening region refers to a heating line which is disposed at an edge portion of the opening region.

In one exemplary embodiment of the present specification, in the heating element according to the first exemplary embodiment, a ratio of the sheet resistance of the first bus bar with respect to the sheet resistance of the first pattern region may be 0.1 or less.

In one exemplary embodiment of the present specification, in the heating element according to the first exemplary embodiment, a deviation of resistance across both ends of the heating lines on the first pattern region connecting the first bus bar and the second pattern region may be 10% or less.

In one exemplary embodiment of the present specification, in the heating element according to the first exemplary embodiment, a deviation of a sheet resistance in an area of 1 cm×1 cm in the second pattern region may be 10% or less.

A second exemplary embodiment of the present specification provides a heating element including a substrate, a first bus bar provided on the substrate, a second bus bar which is provided on the substrate so as to be opposite to the first bus bar, and a heating pattern which is provided to electrically connect the first bus bar and the second bus bar, wherein the heating pattern includes a first pattern region which is in contact with the first bus bar and a second pattern region which is in contact with each of the second bus bar and the first pattern region, and the first pattern region has an opening region which serves as a communication window and the first pattern region includes heating lines which connect the first bus bar and the second pattern region and a deviation of resistance between both ends of the heating lines on the first pattern region connecting the first bus bar and the second pattern region is 10% or less.

In one exemplary embodiment of the present specification, in the heating element of the second exemplary embodiment, a ratio of the sheet resistance of the second pattern region with respect to the sheet resistance of the first pattern region may be 1 or more.

In one exemplary embodiment of the present specification, in the heating element according to the second exemplary embodiment, a ratio of a sheet resistance of the first bus bar with respect to a sheet resistance of the first pattern region may be 0.1 or less.

In one exemplary embodiment of the present specification, in the heating element according to the second exemplary embodiment, a deviation of a sheet resistance in an area of 1 cm×1 cm in the second pattern region may be 10% or less.

In another exemplary embodiment of the present specification, the heating element according to the first or second exemplary embodiment may be for a front glass of a vehicle.

In another exemplary embodiment of the present specification, the heating element according to the first or second exemplary embodiment may be provided for a front glass of a vehicle, the first bus bar is disposed in a position corresponding to a top portion of the front glass of the vehicle, and the second bus bar is disposed in a position corresponding to a bottom portion of the front glass of the vehicle.

In another exemplary embodiment of the present specification, the heating element according to the first or second exemplary embodiment may be provided for the front glass of the vehicle, the second pattern region includes a region corresponding to the center of the driver's field of view when the driver looks straight at a driver's seat.

In another exemplary embodiment of the present specification, the heating element according to the first or second exemplary embodiment may be provided for the front glass of the vehicle, the first pattern region corresponds to a region which does not affect the driver's field of view when the driver looks straight at a driver's seat.

Advantageous Effects

Exemplary embodiments disclosed in the present specification have been made in an effort to provide a heating element which has a communication window to perform communication between the inside and the outside of the heating element and controls nonuniform and local heating in accordance with a deviation of the distance between bus bars.

BRIEF DESCRIPTION OF THE DRAWINGS

FIG. 1 illustrates a first bus bar, a second bus bar, a first pattern region, a second pattern region, and an opening region in a heating element according to an exemplary embodiment disclosed in the present specification.

FIG. 2 illustrates a part of a heating pattern in a first pattern region in a heating element according to another exemplary embodiment disclosed in the present specification.

FIG. 3 illustrates design values of a heating pattern of a first bus bar and a first pattern region designed according to another exemplary embodiment disclosed in the present specification.

FIG. 4 illustrates pattern types of a first pattern region and a second pattern region according to another exemplary embodiment disclosed in the present specification.

BEST MODE

Hereinafter, the present specification will be described in detail.

A heating element according to a first exemplary embodiment of the present specification includes a substrate, a first bus bar provided on the substrate, a second bus bar which is provided on the substrate so as to be opposite to the first bus bar, and a heating pattern which is provided to electrically connect the first bus bar and the second bus bar. The heating pattern includes a first pattern region which is in contact with the first bus bar and a second pattern region which is in contact with each of the second bus bar and the first pattern region. The first pattern region has an opening region which serves as a communication window and a ratio of a sheet resistance of the second pattern region with respect to a sheet resistance of the first pattern region is 1 or more.

FIG. 1 illustrates a configuration of the heating element according to the exemplary embodiment. In FIG. 1, a first bus bar and a second bus bar are provided on a trapezoidal substrate, a first pattern region (B) provided so as to be in contact with the first bus bar, an opening region (A) which is provided in the first pattern region to serve as a communication window, and a second pattern region (C) provided so as to be in contact with the second bus bar and the first pattern region are illustrated. Even though a shape of the substrate is illustrated as a trapezoidal shape under the assumption that the heating element is applied to a front glass of the vehicle which will be described below, but is not limited thereto.

When a ratio of a sheet resistance of the second pattern region with respect to a sheet resistance of the first pattern region is less than 1, heat generated in the first pattern region including an opening region is stronger than heat generated in the second pattern region.

In addition, even though the opening region which serves as the communication window is formed in the heating element, the heating element according to the first exemplary embodiment uniformly controls resistances of patterns which connect between the first bus bar and the second pattern region, thereby controlling nonuniform or local heat generation regardless of the opening region.

In an exemplary embodiment of the present specification, a deviation of resistances between both ends of heating lines on the first pattern region which connects the first bus bar and the second pattern region in the heating element of the first exemplary embodiment is 10% or less.

In the exemplary embodiment of the present specification, each of the first bus bar and the second bus bar includes one power source connecting unit. In this case, the power source connecting units may be located at centers of the first bus bar and the second bus bar in a longitudinal direction. Also in this case, by adjusting a line width or a length of the heating lines, a deviation of the resistances between both ends of the heating lines on the first pattern region which connects the first bus bar and the second pattern region may reach 10% or less, 5% or less, or 2% or less.

When the opening region which serves as the communication window is formed on the front glass of the vehicle, the opening region is desirably provided in a region which does not disturb a region of the driver's field of view, so that the second pattern region is desirably disposed in the viewing region of the driver.

Therefore, the heat generated in the second pattern region is desirably equal to or more than the heat generated in the first pattern region. However, when a ratio of the sheet resistance of the second pattern region with respect to the sheet resistance of the first pattern region is less than 1, the heat is strongly generated in the first pattern region, rather than in the second pattern region corresponding to the viewing region of the driver, so that efficiency of the heating element is lowered due to unnecessarily generated heat.

The above-mentioned sheet resistance may be controlled using a line width, a line length, an interval between lines, a line height, and a material of the heating pattern. When the line width and the length of the line of the heating pattern are adjusted, it is easy to manufacture the heating pattern and design a numerical value.

In the present specification, a sheet resistance of the first pattern region is defined by a value obtained by dividing resistance between both ends of the heating line in a portion where there is no opening region by a distance between the first bus bar and the second pattern region and multiplying the obtained value by an average distance between heating lines.

As an example, when the first pattern region is designed as a linear metal pattern in which the heating lines configuring the first pattern region are spaced apart from each other with the same interval, the sheet resistance is calculated as follows:

$$R=Rs\times L/s=\text{Specific resistance}\times(L/(w\times t)) \quad \text{[Equation 1]}$$

$$Rs=\text{Specific resistance}\times(s/(w\times t)) \quad \text{[Equation 2]}$$

In Equations 1 and 2, R is resistance between both ends of the linear metal patterns, L is a length of the linear metal pattern, s is an interval between linear metal patterns, a specific resistance is a specific resistance of the linear metal pattern, t is a height of the linear metal pattern, and w is a width of the linear metal pattern.

In the present specification, the sheet resistance in the second pattern region means a value obtained by dividing resistance across both ends of a pattern line extending from an interface of the second pattern region which is in contact with the second bus bar to an interface of the second pattern region which is in contact with the first pattern region by a distance between both ends and multiplying the obtained value by a width of the pattern whose resistance is measured. The sheet resistance of the second pattern region may be measured in an arbitrary region of 1 cm×1 cm or more. However, the sheet resistance of the second pattern region may be obtained by measuring a resistance value across an upper end and a lower end of a region which is parallel to the first and second bus bars as a zone where the resistance is measured. As an example, after cutting the second pattern region by a line parallel to the first and second bus bars and by a line perpendicular to the first and second bus bars to form a square, when resistance is measured after forming an electrode in a direction parallel to the first and second bus bars, a distance between both ends of the pattern is equal to a width of the electrode, so that the measured resistance becomes a sheet resistance.

$$R=Rs\times L/W \quad \text{[Equation 3]}$$

In Equation 3, R is resistance between electrodes formed at both ends of an arbitrary square having sides parallel to the bus bar, L is a distance between the electrodes, and W is a width of the electrode.

For example, the sheet resistance of the second pattern region may be measured as a resistance value when resistance is measured by disposing a bus bar in a horizontal direction of a sample having a horizontal length and a vertical length of 1 cm or calculated by the above equation.

When the heating pattern of the first pattern region is designed as illustrated in FIG. 2, a line height of a pattern line is t, a line width is w, and a length extending from the first bus bar to the second pattern region is L, resistance R across the both ends of the pattern line may be calculated by [Specific resistance×L/(w×t)].

In one exemplary embodiment of the present specification, a ratio of the sheet resistance of the second pattern region with respect to the sheet resistance of the first pattern region is 50 or less. In order to configure such that the sheet resistance of the second pattern region exceeds 50 times of the sheet resistance of the first pattern region, a width or a thickness of the pattern in the first pattern region needs to be increased. When the width of the pattern is too large, there may be a problem in visibility and when the thickness of the pattern is too large, there may be a difficulty in the process.

In another exemplary embodiment of the present specification, the heating element is provided for a front glass of the vehicle. The front glass of the vehicle needs to be formed such that the heating pattern is formed so as not to obstruct a driver's field of view. When the second pattern region is disposed in a region of the driver's field of view and the first pattern region is disposed in a region which is regardless of the region of the driver's field of view, for example, in the top portion of the front glass of the vehicle, the opening region in the first pattern region or the heating pattern in the first pattern region does not obstruct the driver's field of view. Therefore, even when the heating element according to the exemplary embodiment described above is applied to the front glass of the vehicle, as long as the first pattern region satisfies the above-described sheet resistance condition, limitations in designing the heating pattern or the opening region in the first pattern region may be significantly reduced.

In another exemplary embodiment of the present specification, the heating element is provided for the front glass of the vehicle, the first bus bar is disposed in a position corresponding to the top portion of the front glass of the vehicle, and the second bus bar is disposed in a position corresponding to the bottom portion of the front glass of the vehicle.

In another exemplary embodiment of the present specification, a length of the first bus bar is desirably equal to a length of the second bus bar.

In another exemplary embodiment of the present specification, a sheet resistance of the first bus bar is desirably equal to a sheet resistance of the second bus bar. When the lengths or the sheet resistances of the first and second bus bars are equal, it is advantageous in controlling the deviation of the sheet resistances in the first and second pattern regions to be small.

In another exemplary embodiment of the present specification, the heating element is provided for the front glass of the vehicle and the second pattern region includes a region corresponding to the center of the driver's field of view when the driver looks straight at a driver's seat. When the second pattern region which does not include the opening region includes a region corresponding to the center of the driver's field of view, it is advantageous in preventing the driver's field of view from being obstructed.

In one specific example, the second pattern region includes regions other than regions defined in "A" and "B" of Article 109 of Rules for Motor Vehicle Safety Standard in Korea.

In another exemplary embodiment of the present specification, the heating element is provided for the front glass of the vehicle and the first pattern region corresponds to a region which does not affect the driver's field of view when the driver looks straight at a driver's seat. For example, when the heating element according to the present specification is applied to the front glass of the vehicle, the heating element is desirably disposed at an upper side rather than the center of the driver's field of view. Since the driver looks straight and forward while driving a vehicle, the heating pattern or the opening region of the first pattern region which is located at the upper side does not obstruct the driver's field of view.

In another exemplary embodiment of the present specification, the opening region which serves as a communication window in the first pattern region is a portion where no heating pattern is formed. As long as the opening region serves as the communication window, a shape and a size of the opening region are not specifically limited. For example, the opening region may be formed to have a rectangular shape or a circular shape.

In another exemplary embodiment of the present specification, the opening region which serves as the communication window in the first pattern region may be formed to be in contact with the first bus bar. In this case, it is advantageous in forming the heating pattern such that the remaining heating pattern other than the opening region in the first pattern region has a uniform sheet resistance. As an example, the opening region which serves as a communication window in the first pattern region may be formed to be in contact with the center of the first bus bar in the longitudinal direction.

In another exemplary embodiment of the present specification, the heating pattern of the first pattern region has a pattern including heating lines extending from an arbitrary point which is in contact with the first bus bar to an arbitrary point which is in contact with the second pattern region.

For example, the first pattern region includes heating lines connecting the first bus bar and the second pattern region. As another example, the first pattern region includes heating lines connecting the first bus bar and the second pattern region and the heating lines are not connected to each other in a portion other than a heating line which partitions the opening region and independently connect the first bus bar and the second pattern region.

The heating lines may be formed by a straight line, a curved line, a zigzag line, or a combination thoseof. In this case, in the heating pattern lines in the first pattern region, a deviation of resistances of the heating lines from the point which is in contact with the first bus bar to the point which is in contact with the second pattern region is 10% or less.

In another exemplary embodiment of the present specification, the heating pattern of the second pattern region may be formed by a regular pattern, an irregular pattern, or a combination those. For example, the heating pattern of the second pattern region may have a polygonal shape or a shape where a degree of curvature of a line of the polygon is modified. A shape where the degree of curvature of a line is modified includes a zigzag shape or a curved shape. The polygon includes a triangle, a rectangle, a pentagon, and a hexagon and so one. The irregular pattern indicates a pattern which is formed so as not to have regularity in at least one of a shape, a size, an interval between lines, a line width, and a line height or other factors of a closed figure. For example, the irregular pattern includes a pattern having no regularity such as a Voronoi pattern or a Delaunay pattern. In FIG. 4, an interface between the second pattern region and the first pattern region is illustrated.

In one exemplary embodiment in the present specification, in the heating element according to the first exemplary embodiment, a ratio of the sheet resistance of the first bus bar with respect to the sheet resistance of the first pattern region is 0.1 or less. In this case, since the resistance change in the longitudinal direction of the first bus bar is smaller than the resistance change across an interface of the first pattern region and the second pattern region, it is advantageous in efficiently generating heat in the first and second pattern regions, specifically, in the second pattern region.

One exemplary embodiment in the present specification provides a heating element in which a deviation of the sheet resistance in the area of 1 cm×1 cm in the second pattern region in the heating element according to the first exemplary embodiment is 10% or less.

An entire opening ratio of the heating pattern is desirably 90% or more.

In one exemplary embodiment of the present specification, each of a deviation of opening ratio in the second pattern region may be 2% or less.

In one exemplary embodiment of the present specification, the heating pattern included in the heating element according to the first exemplary embodiment may be comprised of a conductive material. For example, the heating pattern may be comprised of a metal line.

Specifically, the heating pattern desirably includes a metal having excellent heat conductivity. A specific resistance value of a material of the heating pattern may be 1 μΩ·cm or more and 200 μΩ·cm or less. As the material of the heating pattern, a metal having excellent heat conductivity is desirably used. In the present specification, the thermal conductive material may be used in a particle form. As a specific example of the heating pattern material, such as copper, silver, carbon nanotube (CNT), or copper coated with silver may be used.

The heating pattern may be formed by using first, a method including performing direct printing on the substrate and performing drying or firing, second, a method including laminating a metal thin film on the substrate and patterning the metal thin film, and, third, a method including forming a silver pattern on the substrate on which silver salt is coated by using a photograph manner and increasing a thickness of a line until a desired surface resistance is obtained through plating.

When a printing method which is the first method among the above methods is used, a paste including a thermal conductive material may be printed on a substrate by the printing method. When the printing method is used, a manufacturing process is simple as well as cost is relatively low, a line width is small, and a precise pattern line may be formed.

The printing method is not particularly limited, and a printing method such as an offset printing, a screen printing, a gravure printing and the like may be used. For example, the offset printing may be performed by using the method in which after the paste is filled in the intaglio on which the pattern is formed, primary transferring is performed by using silicon rubber that is called the blanket, secondary transferring is performed by bringing the blanket and glass close contact with each other, but is not limited thereto.

Most of the paste is transferred on glass because of the release property of the blanket, and as a result, a separate blanket washing process is not required. The intaglio may be manufactured by precisely etching the soda lime glass on which the desired pattern line is formed, and metal or DLC (diamond-like carbon) coating may be performed on the glass surface for the durability. The intaglio may be manufactured by etching the metal plate.

In the present specification, in order to implement the more precise pattern line, it is most desirable to use the offset printing method.

The paste may further include an organic binder in addition to the above thermal conductive material so that the printing process is easily performed. The organic binder may have a volatile property in the firing process. Examples of the organic binder include a polyacryl-based resin, a polyurethane-based resin, a polyester-based resin, a polyolefin-based resin, a polycarbonate-based resin, a cellulose resin, a polyimide-based resin, a polyethylene naphthalate-based resin, a denatured epoxy resin and the like, but are not limited thereto.

In order to improve the attachment ability of the paste to the substrate such as glass, the paste may further include a glass frit. The glass frit may be selected from commercial products, but it is preferable to use the environmentally friendly glass frit that includes no lead component. In this case, it is preferable that the average diameter of the glass frit is 2 micrometers or less and the maximum diameter thereof is 50 micrometers or less.

If necessary, a solvent may be further added to the paste. Examples of the solvent include butyl carbitol acetate, carbitol acetate, cyclohexanon, cellosolve acetate, terpineol, and the like, but the scope of the present specification is not limited by these examples.

In the present specification, when a paste including a conductive material, an organic binder, a glass frit and a solvent is used, it is preferred that as the weight ratio of each component, the conductive material is 50 to 90% by weight, the organic binder is 1 to 20% by weight, the glass frit is 0.1 to 10% by weight, and the solvent is 1 to 20% by weight.

In the method including laminating a metal thin film on the substrate and patterning the metal thin film, which is the second method among the above methods, various methods of laminating a metal thin film may be used. For example, the metal thin film may be attached onto the substrate using an adhesive or a metal thin film may be formed on the substrate using a vacuum deposition method. In order to pattern the metal line on the substrate on which the metal thin film is laminated, an etching protective layer may be patterned and then a portion other than the protective layer may be etched. The etching protective layer may be formed by a photolithographic method or formed by an offset printing process.

In one exemplary embodiment of the present specification, the line width of the heating pattern is 30 micrometers or less and particularly, is 0.1 micrometers to 30 micrometers. An interval between lines of the heating pattern may be 50 micrometers to 30 millimeters and the line height (a height of the line) may be 0.2 micrometers to 20 micrometers.

In one exemplary embodiment of the present specification, the line width of the heating pattern of the first pattern region may have a value corresponding to 0.5 to 10 times of a value obtained by multiplying a line width of the second pattern region and an interval between lines of the first pattern region/an interval between lines of the second pattern region. When the line width of the heating pattern of the first pattern region is 0.5 times or more, an increase in resistance across the first pattern region is large, so that it is possible to prevent efficient heat generation of the second pattern region from being hindered, and when the line width is 10 times or less, it is possible to prevent local heat generation between the first pattern region and the second pattern region.

The substrate is desirably transparent. In this case, visible ray transmittance of the substrate is 50% or more and desirably 75% or more. Specifically, as the substrate, glass may also be used, and a plastic substrate or plastic film may be used. When the plastic film is used, after forming the heating pattern, a glass substrate or a plastic substrate is desirably attached onto at least one side of the substrate. In this case, the glass substrate or the plastic substrate is more desirably attached onto a surface of the substrate on which the heating pattern is formed.

A material that is known in the art may be used as the plastic substrate or film, and for example, it is desirable to use the film having the visible ray transmittance of 80% or more such as PET (polyethylene terephthalate), PVB (polyvinylbutyral), PEN (polyethylene naphthalate), PES (polyethersulfone), PC (polycarbonate), and acetyl celluloid. The thickness of the plastic film is desirably 12.5 micrometers to 500 micrometers, and desirably 30 micrometers to 250 micrometers.

The substrate may have a shape forming a curve in accordance with the purpose.

In the present specification, the conductive heating pattern may form a black pattern in order to cover the first or second bus bar. The black pattern may be printed by using a paste that includes cobalt oxides. At this time, it is appropriate that the printing method is the screen printing and the thickness thereof may be set to 10 micrometers to 100 micrometers. The pattern line and the bus bar may be formed before or after forming the black pattern.

The heating element according to the present specification may include an additional substrate which is provided on a surface of the substrate on which the heating pattern is provided. The same description as that of the above-described substrate may be applied to the additional substrate.

When the additional substrate is attached, an adhesive film may be inserted between the heating pattern and the additional substrate. Temperature and pressure may be controlled during the attachment.

In one specific exemplary embodiment, the adhesive film is inserted between the substrate providing the heating pattern and the additional substrate, and the substrates are put into a vacuum bag, and reduced in pressure to increase the temperature or increased in temperature by using the hot roll, to remove the air, thereby accomplishing the first attachment. In this case, the pressure, temperature and time may vary according to the kind of adhesive film, but in general, the temperature may be gradually increased from room temperature to 100° C. at a pressure of 300 to 700 Torr. In this case, it is desirable that the time be generally 1 hour or less. The preliminarily attached laminated structure on which first attachment is completed is subjected to the second attachment process by the autoclave process where the temperature is increased while the pressure is added in the autoclave. The second attachment varies according to the kind of adhesive film, but it is preferable that after the attachment is performed at the pressure of 140 bar or more and the temperature in the range of 130 to 150° C. for 1 to 3 hours, and desirably approximately 2 hours, it is slowly cooled.

In another exemplary embodiment, one step attachment method using the vacuum laminator device unlike the above two step attachment process may be used. The attachment may be performed by increasing the temperature step by step to 80 to 150° C. and slowly cooling the temperature so that the pressure is reduced (to 5 mbar) until the temperature is 100° C. and thereafter adding the pressure (to 1,000 mbar).

Here, any material that has an adhesive strength and is transparent after attachment may be used as the material of the adhesive film. For example, a polyvinylbutyral (PVB) film, an ethylene-vinyl acetate (EVA) film, a polyurethane (PU) film, and so on may be used, but the material is not limited thereto. The adhesive film is not particularly limited, but it is desirable that the thickness thereof is in the range of 100 micrometers to 800 micrometers.

The heating element according to the present specification may be connected to a power source to generate heat, and in this case, the generated heat amount is 100 to 1000 W per $m^2$, and desirably 200 to 700 W per $m^2$. Since the heating element according to the present specification has excellent heating performance at the low voltage, for example, 30 V or less, and desirably 20 V or less, it may be usefully used in vehicles and the like. The resistance of the heating element is 2 ohm/square or less, desirably 1 ohm/square or less, and desirably 0.5 ohm/square or less. In this case, the obtained resistance value has the same meaning as the surface resistance.

A heating element according to a second exemplary embodiment of the present specification includes a substrate, a first bus bar provided on the substrate, a second bus bar which is provided on the substrate so as to be opposite to the first bus bar, and a heating pattern which is provided to electrically connect the first bus bar and the second bus bar. The heating pattern includes a first pattern region which is in contact with the first bus bar and a second pattern region which is in contact with each of the second bus bar and the first pattern region. The first pattern region has an opening region which serves as a communication window and the first pattern region includes heating lines which connect the first bus bar and the second pattern region and a deviation of resistance between both ends of the heating lines on the first pattern region connecting the first bus bar and the second pattern region is 10% or less. It is designed that a deviation of the resistance between both ends of the heating lines connecting the first bus bar on the first pattern region including the opening region and the second pattern region is 10% or less, so that it is advantageous in controlling nonuniform heating in the first pattern region and the second pattern region.

In one exemplary embodiment of the present specification, in the heating element according to the second exemplary embodiment, a ratio of the sheet resistance of the second pattern region with respect to the sheet resistance of the first pattern region is 1 or more.

In one exemplary embodiment in the present specification, in the heating element according to the second exemplary embodiment, a ratio of the sheet resistance of the first bus bar with respect to the sheet resistance of the first pattern region is 0.1 or less.

In one exemplary embodiment in the present specification, in the heating element of the second exemplary embodiment, a deviation of the sheet resistance in the area of 1 cm×1 cm in the second pattern region in the heating element according to the second exemplary embodiment is 10% or less.

In the second exemplary embodiment, other specific description of the heating element is the same as the description of the first exemplary embodiment.

DETAILED DESCRIPTION OF THE INVENTION

Hereinafter, the present specification will be described in detail with reference to specific Examples.

Example 1

According to one exemplary embodiment of the present specification, a first bus bar and a first pattern region are formed as illustrated in FIG. 3, with sizes of Table 1. Copper having a thickness of 50 micrometers is used for the first bus bar and a sheet resistance is $4\times10^4$ ohm/square. After forming a copper thin film having a thickness of 2 micrometers on a substrate, a first pattern region as described above is formed by etching the copper thin film. In the pattern formed as described above, a specific resistance of copper is $1.78\times10^{-8}$ ohm·m, so that a sheet resistance of line 1 to line 21 of the first pattern region may be calculated as follows.

$$Rs=(1.78\times10^{-8}\times20\times10^{-3})/(4\times10^{3}\times2\times10^{-6})=0.04 \text{ ohm/square}$$

TABLE 1

| | Line 1 to 21 | Line 22 | Line 23 | Line 24 | Line 25 | Line 26 | Line 27 | Line 28 |
|---|---|---|---|---|---|---|---|---|
| wn (mm) | 4 | 3.8 | 3.4 | 2.6 | 2.9 | 3.1 | 3.9 | 5.2 |
| Ln (mm) | 168 | 134 | 96 | 56 | 51 | 44 | 44 | 44 |
| wa (mm) | | 6 | 6 | 6 | 6 | 6 | 6 | 6 |
| La (mm) | | 40 | 82 | 122 | 122 | 122 | 122 | 122 |
| wb (mm) | | | | | 6 | 6 | 6 | 6 |
| Lb (mm) | | | | | 22 | 44 | 44 | 44 |
| wc (mm) | | | | | | | 7 | 7 |
| Lc (mm) | | | | | | | 20 | 40 |
| Resistance R over both ends of heating line of first pattern region (ohm) | 0.374 | 0.373 | 0.373 | 0.373 | 0.370 | 0.373 | 0.372 | 0.372 |

As represented in Table 1, a resistance value across both ends of Line 1 to Line 28 may be controlled in the range of 0.370 to 0.374 ohm by adjusting a line width of the heating line of the first pattern region and a length of the line. In this case, an average resistance between both ends of the heating line of the first pattern region in Lines 1 to 28 is 0.374 ohm and a maximum difference between the resistance across the heating lines and the average resistance is 0.004 ohm. Since resistance across a distance (570 mm) from one end of a first bus bar having a width of 25 mm to a center is 0.009 ohm (0.0004×570/25=0.009 ohm) at maximum, an available maximum difference of the resistance between heating lines from one end of the first bus bar to the second pattern region is 0.013 ohm and a value obtained by dividing the maximum difference by an average value, that is, a deviation of resistances between both ends of the heating lines on the first pattern region connecting the first bus bar and the second pattern region is 3%. It is thus known that even when only one power source is provided at the center of the bus bar, as illustrated in FIG. 1, a deviation value of resistance which is consumed to reach the upper end of the second pattern region from the power source via the first pattern region may be controlled within 10%.

As the second pattern region, after patterning an etching resist material on copper having a thickness of 2 micrometers by a photolithography process, a conductive heating pattern region having a metal pattern with a line width of 5 to 8 micrometers and a line height of 2 micrometers is formed by an etching process. A sheet resistance of the second pattern region formed in this case is 0.5 ohm/square.

A ratio of a sheet resistance of the second pattern region with respect to a sheet resistance of the first pattern region is 12.5 (0.5/0.04=12.5). As a result of applying a voltage across both ends of the bus bar using the pattern to generate heat, it is confirmed that heat is uniformly generated in the second pattern region and the heat generation is suppresses in the first pattern region.

Comparative Example 1

Except that a line width of the heating line of the first pattern region is fixed to 4 micrometers, the others are the same as Example 1.

TABLE 2

| | Line 1 to 21 | Line 22 | Line 23 | Line 24 | Line 25 | Line 26 | Line 27 | Line 28 |
|---|---|---|---|---|---|---|---|---|
| wn (mm) | 4 | 4 | 4 | 4 | 4 | 4 | 4 | 4 |
| Ln (mm) | 168 | 134 | 96 | 56 | 51 | 44 | 44 | 44 |
| wa (mm) | | 4 | 4 | 4 | 4 | 4 | 4 | 4 |
| La (mm) | | 40 | 82 | 122 | 122 | 122 | 122 | 122 |
| wb (mm) | | | | | 4 | 4 | 4 | 4 |
| Lb (mm) | | | | | 22 | 44 | 44 | 44 |
| wc (mm) | | | | | | | 4 | 4 |
| Lc (mm) | | | | | | | 20 | 40 |
| Resistance R over both ends of heating line of first pattern region (ohm) | 0.374 | 0.387 | 0.396 | 0.396 | 0.434 | 0.467 | 0.512 | 0.556 |

In Comparative Example 1, different from Example 1, the resistance across both ends of Lines 1 to 28 has a value between 0.374 and 0.556 ohm. In this case, an average resistance between both ends of the heating line of the first pattern region in Lines 1 to 28 is 0.393 ohm and a maximum difference between the resistance across the heating lines and the average resistance is 0.163 ohm. Since resistance across a distance (570 mm) from one end of a first bus bar having a width of 25 mm to a center is 0.009 ohm (0.0004×570/25=0.009 ohm) at maximum, a maximum available difference of the resistance between heating lines from one end of the first bus bar to the second pattern region is 0.172 ohm and a value obtained by dividing the maximum available difference by an average value, that is, a deviation of resistances between both ends of the heating lines on the first pattern region connecting the first bus bar and the second pattern region is 43.8%. That is, it is known that when only one power source is provided at the center of the bus bar, as illustrated in FIG. 1, a deviation value of resistance which is consumed to reach the upper end of the second pattern region from the power source via the first pattern region is not controlled within 10%. In Comparative Example 1, a method of forming Lines 1 to 21 is the same as in Example 1, so that a sheet resistance of the first pattern region is 0.04 ohm/square.

As a result of applying a voltage across both ends of the bus bar using the above-described pattern to generate heat, it is confirmed that the heat is locally generated in the second pattern region.

Example 2

Except that a line width of the heating line of the first pattern region is reduced by 12.5 times as compared with Example 1, the others are same as Example 1. For example, a wn value of Line 1 is reduced from 4 mm to 0.32 mm.

In this case, an average resistance between both ends of the heating line of the first pattern region in Lines 1 to 28 is 4.670 ohm and a maximum difference between the resistance across the heating lines and the average resistance is 0.050 ohm. Since resistance across a distance (570 mm) from one end of a first bus bar having a width of 25 mm to a center is 0.009 ohm (0.0004×570/25=0.009 ohm) at maximum, a maximum available difference of the resistance between heating lines from one end of the first bus bar to the second pattern region is 0.059 ohm and a value obtained by dividing the maximum available difference by an average value, that is, a deviation of resistances between both ends of the heating lines on the first pattern region connecting the first bus bar and the second pattern region is 1.3%. It is known that even when only one power source is provided at the center of the bus bar, as illustrated in FIG. 1, a deviation of resistance which is consumed to reach the upper end of the second pattern region from the power source via the first pattern region is controlled within 10%. When the above-described pattern is used, the sheet resistance of the first pattern region is 0.5 ohm/square and a ratio of the sheet resistance of the second pattern region with respect to the sheet resistance of the first pattern region is 1.

As a result of applying a voltage across both ends of the bus bar using the pattern to generate heat, it is confirmed that the heat is uniformly generated in the second pattern region and the heat is generated in the first pattern region similarly to the second pattern region except for an external communication window.

The invention claimed is:

1. A heating element, comprising:

a substrate;

a first bus bar on the substrate;

a second bus bar on the substrate positioned opposite to the first bus bar; and a heating pattern electrically connecting the first bus bar and the second bus bar, wherein the heating pattern includes a first pattern region that is in contact with the first bus bar and a second pattern region that is in contact with the second bus bar and the first pattern region, and the first pattern region has an opening region which serves as a communication window, and a ratio of a sheet resistance of the second pattern region with respect to a sheet resistance of the first pattern region is 1 or more, wherein in the first pattern region of the heating pattern includes first heating lines that connect the first bus bar and the second pattern region, and the first heating lines are not connected to each other in a portion other than a first heating line partitioning the opening region, and each one of the first heating lines independently connects the first bus bar and the second pattern region.

2. The heating element of claim 1, wherein a deviation of resistance across each of the first heating lines from the first bus bar to an interface between the first pattern region and second pattern region is 10% or less.

3. The heating element of claim 1, wherein a ratio of a sheet resistance of the first bus bar with respect to a sheet resistance of the first pattern region is 0.1 or less.

4. The heating element of claim 1, wherein a deviation of a sheet resistance in the second pattern region is 10% or less.

5. The heating element of claim 1, wherein an opening region which serves as a communication window in the first pattern region is formed to be in contact with the center of the first bus bar in a longitudinal direction.

6. The heating element of claim 1, wherein each of the first bus bar and the second bus bar includes one power source connecting unit.

7. The heating element of claim 1, wherein the heating element is provided for a front glass of a vehicle.

8. The heating element of claim 1, wherein the heating element is provided for a front glass of a vehicle, the first bus bar is disposed in a position corresponding to a top portion of the front glass of the vehicle, and the second bus bar is disposed in a position corresponding to a bottom portion of the front glass of the vehicle.

9. The heating element of claim 1, wherein the heating element is provided for a front glass of a vehicle and the second pattern region includes a region corresponding to a center of a field of view from a driver's seat, and the first pattern region corresponds to a region which does not affect the field of view.

10. A heating element comprising:

a substrate;

a first bus bar on the substrate;

a second bus bar on the substrate positioned opposite to the first bus bar; and a heating pattern electrically connecting the first bus bar and the second bus bar, wherein the heating pattern includes a first pattern region that is in contact with the first bus bar and a second pattern region that is in contact with each of the second bus bar and the first pattern region, and the first pattern region has an opening region that serves as a communication window, and the first pattern region includes heating lines that connect the first bus bar and the second pattern region, and a deviation of resistance of each heating line from the first bus bar to an interface between the first pattern region and second pattern region is 10% or less, wherein the heating lines in the first pattern region are not connected to each other in a portion other than a heating line partitioning the opening region, and each heating line independently connects the first bus bar and the second pattern region.

11. The heating element of claim 10, wherein a ratio of a sheet resistance of the second pattern region with respect to a sheet resistance of the first pattern region is 1 or more.

12. The heating element of claim 10, wherein a ratio of a sheet resistance of the first bus bar with respect to a sheet resistance of the first pattern region is 0.1 or less.

13. The heating element of claim 10, wherein a deviation of a sheet resistance in the second pattern region is 10% or less.

* * * * *